US007971409B2

(12) United States Patent
Bak et al.

(10) Patent No.: US 7,971,409 B2
(45) Date of Patent: Jul. 5, 2011

(54) BEAM SHOE

(75) Inventors: Jeppe Mølbæk Bak, Odder (DK); Henrick Bentsen, Odder (DK); Ian Harrison, Nottingham (GB); Jørn Ipsen, Odder (DK); Charles-Henri Mathis, La Rochelle (FR)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 10/850,518

(22) Filed: May 19, 2004

(65) Prior Publication Data

US 2004/0244328 A1 Dec. 9, 2004

(30) Foreign Application Priority Data

May 19, 2003 (DE) ..... 203 07 769 U

(51) Int. Cl.
*E04C 5/01* (2006.01)
*E04C 5/02* (2006.01)

(52) U.S. Cl. ..... 52/696; 52/712; 52/715; 52/714; 29/897.34

(58) Field of Classification Search ..... 52/696, 52/702, 712, 714, 715; 403/232.1, 168, 235; 29/897.34
See application file for complete search history.

(56) References Cited

U.S. PATENT DOCUMENTS 414,169 A 10/1889 Reuschel
(Continued)

FOREIGN PATENT DOCUMENTS

EP 0 357 273 A1 3/1990
(Continued)

OTHER PUBLICATIONS

"Panelized Construction" *Handbook of Structural Designs & Load Values.* Simpson Strong-Tie Timber Connectors, Catalog No. 79H-1 1979. Simpson Strong-Tie Co., Inc. Copyright 1978, p. 16.

(Continued)

*Primary Examiner* — Phi Dieu Tran A
(74) *Attorney, Agent, or Firm* — James R. Cypher; Charles R. Cypher

(57) ABSTRACT

A beam shoe for attaching a (first) beam end-on to a load-bearing construction, especially to a second beam disposed in the same plane as the beam to be attached and running at right angles thereto, the beam shoe comprising an originally flat, one-piece, strip-like sheet-metal portion or blank, which is shaped to an upwardly open channel-shaped retaining member having a web-like rectangular bottom for bracing the beam to be attached on the beam shoe as well as two web-like, parallel retaining legs, the retaining member embracing, in assembled condition, an end portion of the beam to be attached at the underside and side faces thereof, the legs, which are bent over upwardly from the bottom at right angles and disposed along two opposite borders of the bottom, being provided with through holes for rod-like fasteners such as nails in particular in order to join the beam shoe to the beam to be attached, the inside spacing of the legs therefore being (at least) as large as (and if necessary somewhat larger than) the width of the beam to be attached, wherein a fastening flange provided with through holes for rod-like fasteners such as nails and/or screws is bent over at right angles along that longitudinal border of each retaining leg which faces the load-bearing construction (or if necessary the second beam), the fastening flange being designed to be placed with its outside face remote from the channel-shaped retaining member of the beam shoe on the load-bearing construction/the second beam and to be fastened thereto with rod-like fasteners such as nails and/or screws, and wherein the web-like bottom is reinforced by a (bottom) reinforcing flange or the like in order to increase its section modulus against sagging under relatively large load.

18 Claims, 4 Drawing Sheets

U.S. PATENT DOCUMENTS

| | | | | | |
|---|---|---|---|---|---|
| 625,427 | A | | 5/1899 | Stewart | |
| 828,488 | A | * | 8/1906 | Lanz | 29/897.3 |
| 974,606 | A | | 11/1910 | Schrader | |
| 1,343,647 | A | | 6/1920 | Smith | |
| 1,568,072 | A | | 1/1926 | Krueger et al. | |
| 1,719,440 | A | * | 7/1929 | Nathan | 5/130 |
| 1,785,791 | A | | 12/1930 | Ropp | |
| 1,787,167 | A | | 12/1930 | Purdy | |
| 1,925,804 | A | | 9/1933 | Hiering | |
| 1,945,925 | A | * | 2/1934 | Stiefel | 403/2 |
| 1,958,467 | A | | 5/1934 | Buckle | |
| 2,006,925 | A | | 7/1935 | Klemp | |
| 2,055,185 | A | * | 9/1936 | Templeton | 72/374 |
| 2,086,225 | A | | 7/1937 | Hiering | |
| 2,330,766 | A | | 9/1943 | Walstrom | |
| 2,638,643 | A | | 5/1953 | Olson | |
| 2,988,854 | A | | 6/1961 | McKinley | |
| 2,990,590 | A | * | 7/1961 | Graveley | 403/189 |
| 3,036,347 | A | | 5/1962 | Findleton | |
| 3,041,033 | A | | 6/1962 | Schwartz | |
| 3,055,103 | A | | 9/1962 | Femberg | |
| 3,271,861 | A | | 9/1966 | Fusco | |
| 3,338,084 | A | | 8/1967 | Stegman | |
| 3,423,898 | A | | 1/1969 | Coloney et al. | |
| 3,438,134 | A | | 4/1969 | Schunk | |
| 3,457,647 | A | | 7/1969 | Cohen | |
| 3,596,941 | A | | 8/1971 | Tracy | |
| 3,601,428 | A | | 8/1971 | Gilb | |
| 3,633,950 | A | | 1/1972 | Gilb | |
| 3,730,466 | A | | 5/1973 | Swanquist | |
| 3,857,270 | A | | 12/1974 | Iten | |
| 3,879,144 | A | | 4/1975 | Eckerbrecht | |
| 3,972,169 | A | * | 8/1976 | Sheppard, Jr. | 52/702 |
| 4,230,416 | A | | 10/1980 | Gilb | |
| 4,291,996 | A | | 9/1981 | Gilb | |
| 4,410,294 | A | | 10/1983 | Gilb et al. | |
| 4,414,785 | A | | 11/1983 | Howell | |
| 4,423,977 | A | | 1/1984 | Gilb | |
| 4,449,335 | A | | 5/1984 | Fahey | |
| 4,480,941 | A | * | 11/1984 | Gilb et al. | 403/232.1 |
| 4,498,801 | A | | 2/1985 | Gilb | |
| 4,525,972 | A | | 7/1985 | Palacio et al. | |
| 4,572,695 | A | | 2/1986 | Gilb | |
| 4,598,521 | A | | 7/1986 | Slapsys et al. | |
| 4,711,593 | A | | 12/1987 | Wilhelmi | |
| 4,717,279 | A | | 1/1988 | Commins | |
| 4,802,786 | A | | 2/1989 | Yauger | |
| 4,817,359 | A | | 4/1989 | Colonias | |
| 4,890,436 | A | | 1/1990 | Colonias | |
| 4,897,979 | A | | 2/1990 | Colonias | |
| 4,920,725 | A | | 5/1990 | Gore | |
| 4,932,173 | A | * | 6/1990 | Commins | 52/92.2 |
| 4,964,253 | A | | 10/1990 | Loeffler | |
| 5,022,209 | A | | 6/1991 | Kimura | |
| 5,042,217 | A | | 8/1991 | Bugbee et al. | |
| 5,104,252 | A | | 4/1992 | Colonias et al. | |
| 5,203,069 | A | | 4/1993 | Hennig | |
| 5,236,273 | A | * | 8/1993 | Gilb | 403/232.1 |
| 5,253,465 | A | * | 10/1993 | Gilb | 52/643 |
| 5,263,296 | A | | 11/1993 | Spera | |
| 5,274,981 | A | | 1/1994 | Commins | |
| 5,341,619 | A | | 8/1994 | Dunagan et al. | |
| 5,364,312 | A | * | 11/1994 | Cunard et al. | 472/118 |
| 5,367,853 | A | | 11/1994 | Bryan | |
| 5,380,115 | A | | 1/1995 | Colonias | |
| 5,380,116 | A | * | 1/1995 | Colonias | 403/232.1 |
| D355,349 | S | | 2/1995 | Taparauskas, Jr. | |
| D363,862 | S | | 11/1995 | Lusignan | |
| D364,331 | S | | 11/1995 | Leek | |
| 5,524,397 | A | | 6/1996 | Byers et al. | |
| 5,598,680 | A | | 2/1997 | Wilhelmi | |
| 5,603,580 | A | * | 2/1997 | Leek et al. | 403/232.1 |
| 5,666,774 | A | | 9/1997 | Commins | |
| D392,144 | S | | 3/1998 | Vogler | |
| 5,727,831 | A | | 3/1998 | Dritlein, Jr. | |
| 5,806,265 | A | | 9/1998 | Sluiter | |
| 5,951,078 | A | | 9/1999 | Whiteheaed et al. | |
| 5,987,828 | A | | 11/1999 | Hardy | |
| 6,230,466 | B1 | | 5/2001 | Pryor | |
| 6,254,306 | B1 | * | 7/2001 | Williams | 403/403 |
| 6,260,402 | B1 | | 7/2001 | Leek | |
| 6,338,511 | B1 | | 1/2002 | Douglas et al. | |
| 6,446,409 | B1 | * | 9/2002 | Emerson | 52/712 |
| 6,523,321 | B1 | * | 2/2003 | Leek et al. | 52/702 |
| 6,625,945 | B2 | | 9/2003 | Commins | |
| 6,655,099 | B1 | | 12/2003 | Trenoweth | |
| 6,662,517 | B1 | | 12/2003 | Thompson | |
| 6,840,020 | B2 | * | 1/2005 | Leek et al. | 52/712 |
| 6,983,548 | B1 | | 1/2006 | Cook et al. | |
| 2001/0002529 | A1 | | 6/2001 | Commins et al. | |
| 2002/0002806 | A1 | | 1/2002 | Commins et al. | |
| 2002/0020137 | A1 | | 2/2002 | Commins | |
| 2004/0065032 | A1 | | 4/2004 | Commins | |
| 2004/0079044 | A1 | * | 4/2004 | Troth et al. | 52/696 |

FOREIGN PATENT DOCUMENTS

| | | | | |
|---|---|---|---|---|
| EP | 1 413 686 | A1 | | 4/2004 |
| GB | 185694 | | | 9/1922 |
| GB | 422765 | | | 1/1935 |
| GB | 1179267 | | | 6/1967 |
| GB | 2 018 935 | | | 10/1979 |
| GB | 2 070 184 | A | | 9/1981 |
| GB | 2 228 955 | | | 9/1990 |
| GB | 2228955 | A | * | 9/1990 |
| JP | 6-262267 | | | 9/1994 |
| WO | WO 00/53352 | | | 9/2000 |

OTHER PUBLICATIONS

"Formed Seat Joist Hangers." *Joist Hangers and Framing Connectors. Structural Designs & Load. Values.* Simpson Catalog No. 66H1. Simpson Strong-Tie Co., Inc.Copyright 1965, p. 3.

*Konstruieren mit Sichtholz-Verbindem and der größten Auswahl einbaufertiger Serienteile.* Bulldog-Simpson Bausysteme für Holz catalog, Bulldog-Simpson GMBH catalog,Copyright 1999, Cover Page and p. 3.

"Glulam Saddle Hanger" Strong-Tie Connectors, Catalog No. 71H1, Simpson Strong-Tie Company, Inc. 1971, p. 13.

"EPB44T Elevated Post Bases" Simpson Strong-Tie Connectors—Wood Constructions Connectors, Catalog C02000, Simpson Strong-Tie Company, Inc. 2000, p. 34.

RTA/RTB/RTF/RTT/RTU/FW2 RIGID Tie Connectors Simpson Strong-Tie Connectors for Wood Construction Product & Instruction Manual Catalog C95H-1, p. 67, Simpson Strong-Tie Company, Inc. Pleasanton, CA 1994.

"Gluiam Saddle Hanger" Strong-Tie Connectors, Catalog No. 71H1, Simpson Strong-Tie Company, Inc. 1971, p. 13.

"EPB44T Elevated Post Bases" Simpson Strong-Tie Connectors—Wood Constructions Connectors. Catalog C0200, Simpson Strong-Tie Company, Inc. 2000 p. 34.

"HJ Hip & Jack Truss Hanger" Product Data Sheet. Cleveland Steel Specialty Co. 1986.

"Structural Truss Connectors." Lumberlok: Structural Framing Connectors Catalog & Specifications. p. 37, Lumberlok. Hayward, Calif. 1988.

"THJA26 Truss Hip and Jack Hanger." Product Data Sheet. Simpson Strong-Tie Company, Inc. San Leandro, Calif. 1991.

"MTHM/MTHM-2 Multiple Truss Hangers." Simpson Strong-Tie Company Wood Construction Connectors Catalog C-2000, p. 92. Simpson Strong-Tie Company, Inc. Pleasanton, Calif. 1999.

"RTC Rigid Tie™ Connectors." Simpson Strong-Tie Company Wood Construction Connectors Catalog C-2000, p. 113. Simpson Strong-Tie Company, Inc., Pleasanton, Calif. 1999.

"SBV/CF Shelf Bracket—Concrete Form Angle" Simpson Strong-Tie Connectors for Wood Construction Product & Instruction Manual Catalog C95H-1, p. 65. Simpson Strong-Tie Company, Inc. Pleasanton, Calif. 1994.

RTA/RTB/RTF/RTT/RTU/FW2 Rigid Tie™ Connectors Simpson Strong-Tie Connectors for Wood Construction Product & Instruction Manual Catalog C95H-1, p. 67. Simpson Strong-Tie Company, Inc. Pleasanton, Calif. 1994.

* cited by examiner

Fig. 1
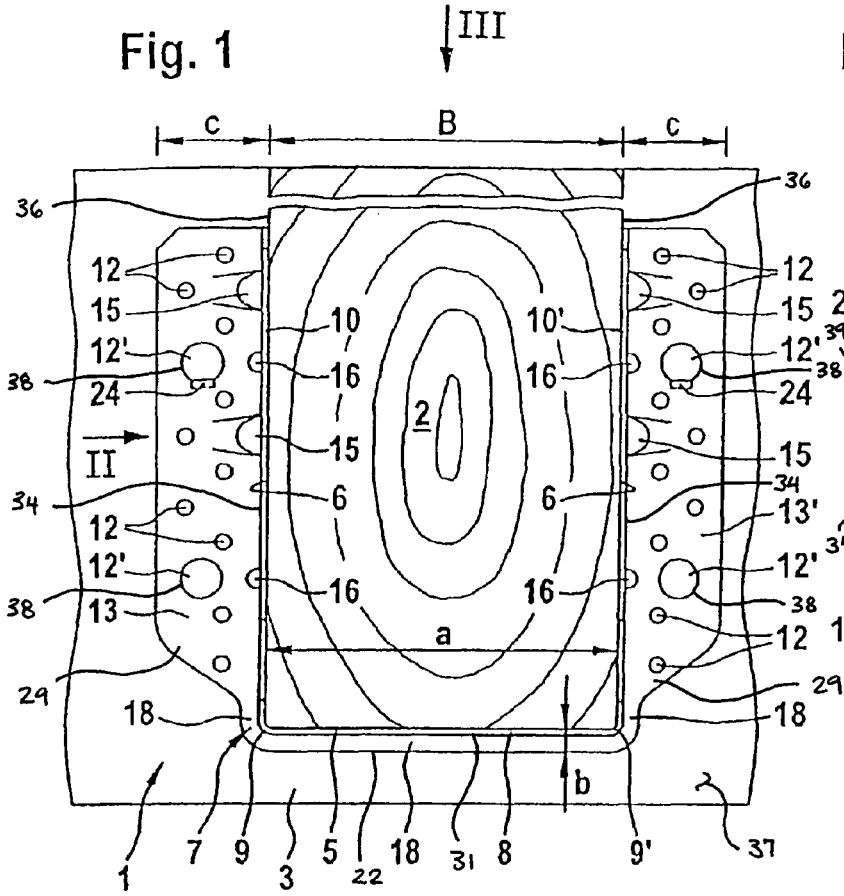
Fig. 2
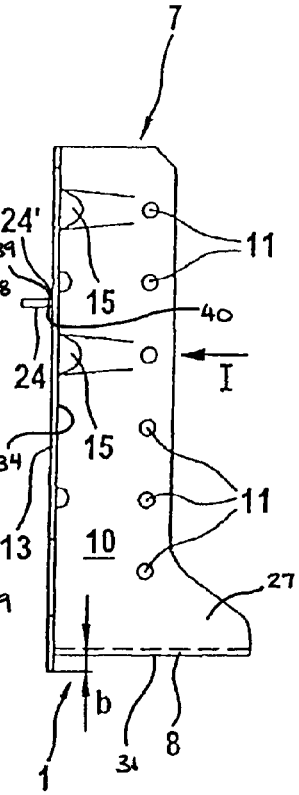
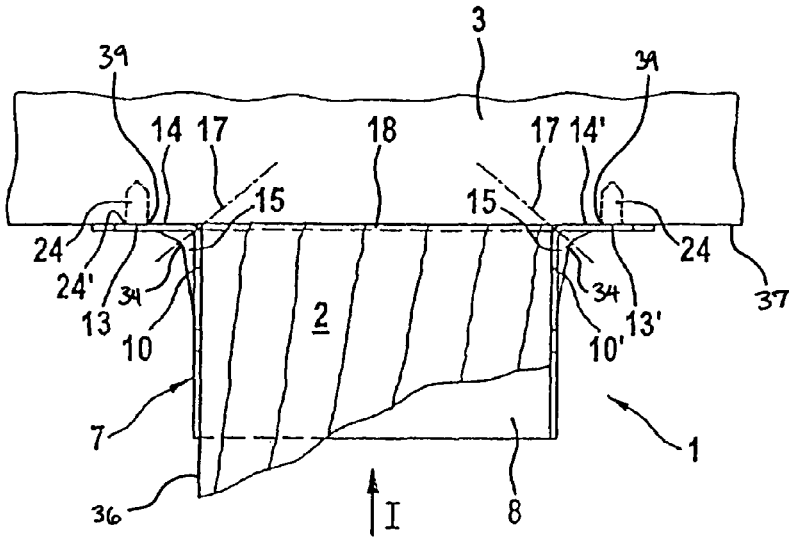
Fig. 3

BEAM SHOE

BACKGROUND OF THE INVENTION

The present invention relates to a beam shoe for attaching a (first) beam end-on to a load-bearing construction, especially to a second beam disposed in the same plane as the beam to be attached and running at right angles thereto, the beam shoe comprising an originally flat, one-piece, strip-like sheet-metal portion or blank, which is shaped to an upwardly open channel-shaped retaining member having a web-like rectangular bottom for bracing the beam to be attached on the beam shoe as well as two web-like, parallel retaining legs, the retaining member embracing, in assembled condition, an end portion of the beam to be attached at the underside and side faces thereof, the legs, which are bent over upwardly from the bottom at right angles and disposed along two opposite borders of the bottom, being provided with through holes for rod-like fasteners such as nails in particular in order to join the beam shoe to the beam to be attached, the inside spacing of the legs therefore being (at least) as large as (and if necessary somewhat larger than) the width of the beam to be attached, wherein a fastening flange provided with through holes for rod-like fasteners such as nails and/or screws is bent over at right angles along that longitudinal border of each retaining leg which faces the load-bearing construction (or if necessary the second beam), the fastening flange being designed to be placed with its outside face remote from the channel-shaped retaining member of the beam shoe on the load-bearing construction/the second beam and to be fastened thereto with rod-like fasteners such as nails and/or screws, and wherein the web-like bottom is reinforced by a (bottom) reinforcing flange or the like in order to increase its section modulus against sagging under relatively large load.

Beam shoes are used in wood construction for attachments of solid or glued laminated beams in the same plane. They have the advantage among others of simple, rapid and reliable assembly, without weakening the wood members at the attachment point.

Besides beam shoes having fastening flanges bent over outwardly at right angles from the retaining legs, there are known beam shoes having fastening flanges bent over inwardly at right angles from the retaining legs. Furthermore, there is also known a beam shoe which, instead of being provided with the two fastening shoes bent over from the retaining legs, is provided with a back wall running between the retaining legs, a fastening flange provided with through holes for rod-like fasteners for mounting the beam shoe on a second beam being bent over at right angles at the upper end of the back wall.

Beam shoes having two fastening flanges are generally fastened first to a main beam of the load-bearing construction. Thereafter the beam to be attached is inserted in the beam shoe assigned to it in such a way that it is braced on the bottom thereof and can then be nailed to the retaining legs.

Common to all known beam shoes is that—simply for cost reasons—they are made from an originally flat, one-piece sheet-metal portion (blank) which, after being cut out or stamped from heavy sheet metal of predetermined thickness, is shaped by means of appropriate machines or tools. In this operation, it is therefore very important from economic viewpoints to organize the shaping of the beam shoe in such a way that cutting of the blank can be achieved with the lowest possible losses and preferably without losses.

In beam shoes of the class in question, without bottom reinforcing flange, undesired or possibly even inadmissible sagging of the beam-shoe bottom occurs during relatively large load on the beam to be attached as a result of transverse forces acting vertically on the bottom of the beam shoe. In order to counteract or at least largely prevent this "cable effect", bead-like stiffening ribs have been pressed into the bottom, but they have not led to an adequate increase of the section modulus compared with an unshaped bottom.

For this reason a reinforcing flange bent over at right angles inwardly or upwardly or else outwardly or downwardly has already been provided along the border of the beam-shoe bottom. In the finished beam shoe, this reinforcing flange is disposed in the plane of the two fastening flanges and protrudes perpendicularly from the bottom in the manner of a tongue. Nevertheless, even these configurations are not yet satisfactory for the desired goal of a substantially bending-proof bottom, since these tongues are narrower than the bottom and therefore are joined only to that bottom, but not to the retaining legs, and so the section modulus can be increased to only a limited extent in the lower portion of the channel-shaped retaining member.

A further disadvantage of known beam shoes of the class in question is that their blanks cannot be cut with low losses or even without losses, since the sheet-metal portion forming the reinforcing flange in the finished beam shoe protrudes in the manner of a tongue beyond the same bending line of the blank in the region of the middle blank portion forming the bottom after shaping. From this portion there is extended, into the two outer end portions of the strip-like sheet-metal blank, that portion which, after shaping, corresponds to the contour of the sheet-metal portion protruding in the manner of a tongue and forming the fastening flanges but not to the contour of the strip-like blank along the longitudinal border thereof. Under the best circumstances, therefore, it has been possible to counter this loss (of sheet metal) only if the portion of the blank forming the bottom is appropriately recessed along its border opposite the reinforcing-flange portion. However, this feature would lead to weakening of the bottom, even though its bending resistance is supposed to be increased with this feature.

Furthermore, it must be considered that the sheet-metal thickness of any wood fasteners will be kept as small as possible for cost reasons, although at the same time it has been assumed heretofore that the sheet-metal thickness of beam shoes for common applications must not be less than 2 mm precisely because of the feared bottom sagging.

SUMMARY OF THE INVENTION

The object of the present invention is to improve the beam shoe of the class described hereinabove especially to the effect that it can be formed from a blank created with low losses, preferably substantially without losses, while achieving a distinct increase of the section modulus of its bottom by means of a reinforcing flange provided in the region thereof, wherein, by virtue of the achievable bottom reinforcement, it can be used with a sheet thickness that if necessary is smaller than that of conventional beam shoes, such as 1.5 mm and less, and wherein, despite the achieved reinforcement, flush contact between the beam to be attached and the load-bearing construction/the second beam is possible without having to recess it (or the load/bearing construction/the second beam) in the region of the reinforcing flange.

This object is achieved according to the invention by the fact that the (bottom) reinforcing flange is formed by a strip-like sheet-metal portion running in the plane of the two fastening flanges, the sheet-metal portion extending at least over the entire width of the bottom between the lower end portions of the two retaining legs adjacent the bottom. Thereby the bottom provided with the reinforcing flange forms, together with the lower end portions of the two retaining flanges, a three-dimensional structure of high rigidity, and it can absorb the bending forces and torques developed at the bottom-corner edges largely without deformation.

In a beam shoe whose fastening flanges are each bent over outwardly from a retaining flange, it is preferably provided that the sheet-metal portion forming the reinforcing flange extends integrally downward from the lower end of the one fastening flange to the outside of the lower end portion of the neighboring retaining flange and further at the underside of the bottom to the lower end of the other fastening flange and from there merges integrally thereinto.

In this beam shoe, the channel-shaped retaining member comprising the two retaining legs and the bottom is therefore surrounded virtually all around, along its border facing the load-bearing construction/the second beam, by an integral, channel-shaped sheet-metal portion extending at right angles to the bottom and to the two fastening flanges, since the bottom reinforcing flange continues upward beyond the bottom and at its two ends merges into the respective fastening flange. Preferably, however, this surrounding portion is narrower in the region of the bottom and in a contiguous lower portion thereabove than in the region of the fastening flanges. This leads not only to a very considerable increase of the section modulus in the bottom region, wherein the bending torques developed under corresponding transverse-force load or the forces resulting therefrom can be diverted by that lower portion of the channel-shaped retaining member which is provided with the reinforcing flange into the fastening flange and then be absorbed thereby, but also to a possible decrease of the sheet-metal thickness for the same load and, last but not least, to the possibility of cutting the sheet-metal blank without losses.

Thus, whereas the bending line for bending over the fastening flanges in the sheet-metal blank for a conventional beam shoe without reinforcing flange runs from the portions forming the retaining legs along the rear border of the portion forming the bottom, thus bounding this portion at the rear, and whereas the reinforcing rib in the blank for a known beam shoe of the class in question is formed by a trapezoidal or rectangular portion that protrudes in the region of the sheet-metal portion forming the bottom and has a length shorter than the planned inside spacing between the two retaining legs, so that the blank is bounded at least pointwise by the bending line between the portion forming the reinforcing flange and the two portions forming the fastening flanges, this bending line in the blank for the inventive beam shoe runs continuously at a distance from the rear longitudinal border of the blank, with the result that, after shaping around this bending line, the reinforcing flange continues upward along both end portions around the bottom and merges smoothly into the fastening flanges, as will be further described hereinafter.

In another configuration, in which the fastening flanges may also be bent over inwardly if necessary from the retaining flanges, and in which the sheet-metal portion forming the reinforcing flange is bent over inwardly at right angles in a manner known in itself, this sheet-metal portion bears firmly with its two end faces against the respective inside of the lower end portion of one retaining flange, and preferably does so under (compressive) stress, so that—differently from in the prior art, in which the end faces of the reinforcing flange are spaced apart from the insides of the retaining flanges—a highly bending-resistant structure is also obtained in the bottom region of the beam shoe when it is in assembled condition, even if the reinforcing flange is not joined to the retaining flanges (especially by welding), since it is firmly clamped between the beam to be attached and the load-bearing construction/the second beam, and therefore cannot slip out due to possible buckling, and therefore can transmit the bending torques or forces imposed on it to the retaining legs.

The invention will be explained in further detail hereinafter in practical examples with reference to a drawing, wherein:

BRIEF DESCRIPTION OF THE FIGURES

FIG. 1 shows a lateral top view of a beam shoe, viewed in the direction of arrow I in FIG. 2 and FIG. 3;

FIG. 2 shows a side view of the beam shoe according to FIG. 1, viewed in the direction of arrow II in FIG. 1;

FIG. 3 shows a top view of the beam shoe according to FIGS. 1 and 2, viewed in the direction of arrow III in FIG. 1;

LIST OF REFERENCE NUMERALS

Figure 4:
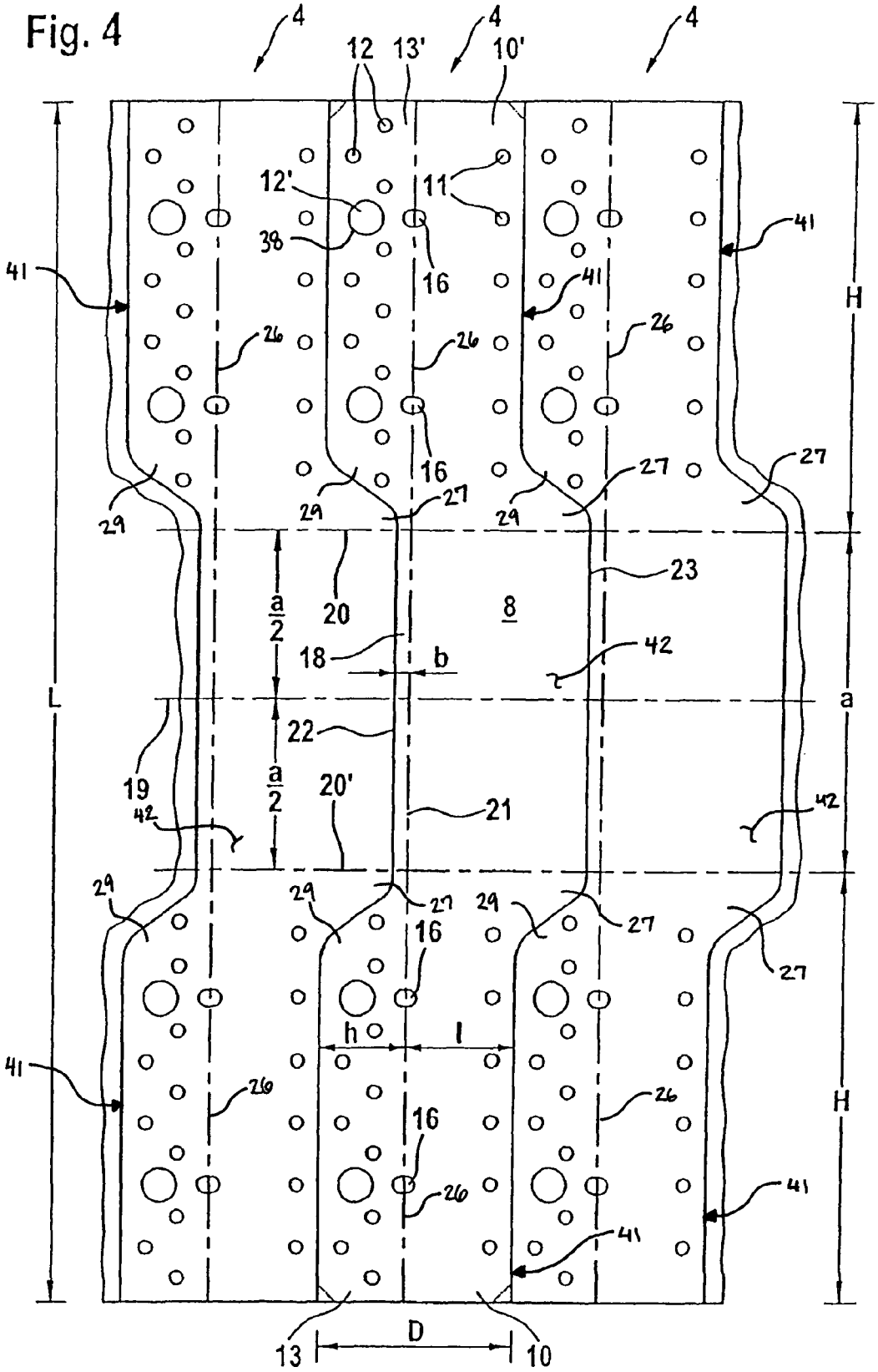
FIG. 4 shows a blank diagram for the beam shoe according to FIGS. 1 to 3 with three beam-shoe blanks in as yet unshaped condition, in top view.

1 Beam shoe
2 (First) beam to be attached
3 Second beam (load-bearing construction)
4 (Sheet-metal) blank
5 Underside (of 2)
6 Side faces
7 Retaining member
8 Bottom
9 Border (of 8)
10 Retaining leg
11 Through holes
12 Through holes
13 Fastening flange
14 Contact side
15 Bead-like convex structure
16 Through holes
17 Screws
18 Reinforcing flange
19 Transverse centerline
20 First bending line
21 Second bending line
22 Rear edge (of 8)
23 Front edge (of 8)
24 Projection
25 Recess (of 18)
9' Border (of 8)
10' Retaining leg
12' Through holes
13' Fastening flange
14' Contact side
18' End faces (of 18)
20' First bending line
24' Bending border (of 24)
26 Longitudinal border (of 10, 10')
27 Lower end portion (of 10, 10')
29 Lower end (of 13, 13')
31 Underside (of 8)

32 Inner sides (of 27)
34 Angular juncture (between 10, 10' and 13, 13')
36 Side faces (of 2)
37 Attachment face (of 3)
38 Border (of 12')
39 Inside ends (of 24)
40 Notch (of 24)
41 End portions (of 4)
42 Middle (of 4)
a width of bottom 8
b first height of reinforcing flange 18
b' second height of reinforcing flange 18
D width of blank 4
e length of reinforcing flange 18 between first bending lines 20, 20' and interruption of reinforcing flange 18
h width of fastening flanges 13, 13'
H height of fastening flanges 13, 13'
l length of retaining legs 10, 10'
L length of blank 4

DETAILED DESCRIPTION OF THE INVENTION

FIGS. 1 to 3 show a beam shoe denoted as a through hole by 1 for end-on attachment of a first beam 2 to a second beam 3 running in the same plane at right angles to the first beam 2. Beam shoe 1 comprises an originally flat, one-piece, strip-like sheet-metal blank 4 (see FIG. 4), which in the assembled condition (see FIGS. 1, 3) surrounds an end portion of beam 2 to be attached at its underside 5 and its side faces 6, 6 and is shaped to an upwardly open, channel-shaped retaining member 7 having a web-like, rectangular bottom 8 for bracing beam 2 to be attached on beam shoe 1 and having two web-like, parallel retaining legs 10, 10', angled upwardly from bottom 8 along two mutually facing borders 9, 9' of border 8, for joining beam shoe 1 to beam 2 to be attached. Therein the inside spacing "a" between the two retaining legs 10, 10' is as large as the width "B" of first beam 2 to be attached, and the two retaining legs 10, 10' are each provided with circular through holes 11 distributed substantially uniformly over their height. After beam 2 to be connected has been mounted, nails can be driven from outside through the holes into beam 2 in order to fasten it to beam shoe 1.

Along the longitudinal border of each retaining leg 10, 10' facing second beam 3 there are bent over outwardly at right angles fastening flanges 13 and 13' respectively provided with through holes 12 for nails to be driven in or with through holes 12' for screws to be introduced. The fastening flanges can be placed with their contact faces 14 and 14' respectively remote from channel-shaped retaining member 7 along second beam 3 and fastened thereto with nails and/or screws.

For reinforcement of the angle portions comprising respectively a retaining leg 10 or 10' and a fastening flange 13 or 13' there are provided, in the corner region of angle portions 10, 13 or 10', 13', two outwardly directed, bead-like convex structures 15.

Furthermore, directly in the angle edges between a retaining leg 10 or 10' and fastening flange 13 or 13' associated therewith, there are provided through holes 16', which are designed such that further rod-like fasteners such as especially wood screws can be driven in obliquely relative to the longitudinal extent of beam 2 to be attached (see dot-dash lines in FIG. 3), so that in this way forces acting horizontally on beam 2 can be better absorbed.

As can be seen in particular in FIGS. 1 and 2, the two fastening flanges 13, 13' end not in conventional manner at a distance from bottom 8 of beam shoe 1, but instead each continues on under bottom 8 while respectively forming a reinforcing flange 18, and from there merges continuously into the "actual" bottom-reinforcing flange 18. This therefore comprises a strip-like sheet-metal portion, which has a width or height "b" and protrudes at right angles from the rear border of bottom 8 or (in the lower portion) of fastening flanges 13, 13', and therefore also reinforces bottom 8 against sagging in the presence of considerable vertical transverse forces, because it ends not at the side borders of bottom 8 as in the prior art, but instead embraces them and then merges into fastening flanges 13, 13'.

Nevertheless—as shown in FIG. 4—the blank for the inventive beam shoe can be formed practically without losses from heavy sheet metal. FIG. 4 shows three successive blanks 4, from each of which a beam shoe 1 is to be shaped. Therein through holes 11, 12, 12' and 16 are already indicated, and the individual portions of blank 4 are each provided with the reference numerals of that part of beam shoe 1 that they comprise after shaping.

It is evident that two dot-dash first bending lines 20, 20', around which the respective blank portions 10, 13 and 10', 13' located on the other side of bottom 8 to be formed are to be bent up at right angles to bottom portion 8, run on both sides of transverse centerline 19 of each strip-like sheet-metal blank 4, with a spacing of "a/2" (which is equal to half the bottom width "a") relative to the transverse centerline 19, and that, running at right angles to first bending lines 20, 20', there is a second bending line 21, around which the portions forming fastening flanges 13 and 13' are to be bent over outwardly at right angles to adjacent retaining-leg portions 10 and 10', wherein second bending line 21 runs continuously with a spacing b relative to rear edge 22 of middle portion 8 located between the first two bending lines 20, 20', so that the region disposed between second bending line 21 and front edge 23 of the middle portion forms bottom 8 during shaping of blank 4 around second bending line 21, and the region disposed between second bending line 21 and rear edge 22 of the middle portion forms, in the region of bottom 8 as well as in the region of the two portions 13 and 13' respectively adjoining it, a portion (which therefore is integrally contiguous) in which reinforcing flange 18 has height "b" (see FIGS. 1, 2). From FIG. 4 it is immediately obvious that a plurality of blanks 4 adjoin one another without gaps, so that they can be cut out or stamped from heavy sheet-metal stock without losses.

It must also be added that, in the region of fastening flanges 13, 13' there is provided, in the region of the upper (larger) through hole 12', a spike-shaped fixing projection 24 for fixing beam shoe 1 to second beam 3, the projection being bent over at right angles from the plane of the respective fastening flange 13 and 13' toward the contact side, and at its bending border 24' being provided with a notch as a predetermined breaking point, so that it can be removed, simply by knocking it off with a hammer if necessary, if fixing projections 24 are not needed or would even be a detriment, as would be the case if load-bearing structure 3 to which beam 2 is to be attached were not a wooden component.

Figure 5:
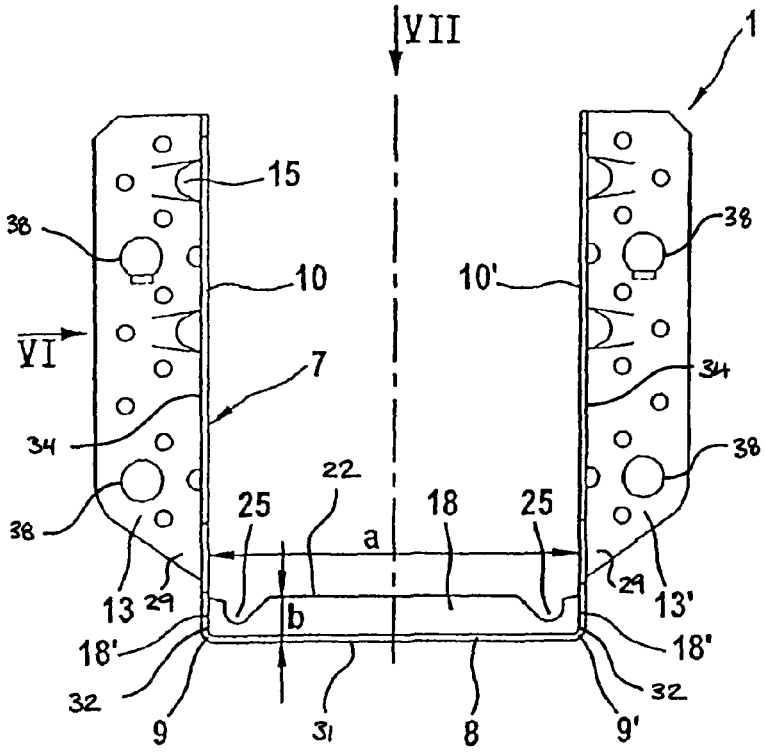
FIG. 5 shows another configuration of the beam shoe in lateral top view, viewed in the direction of arrow V in FIG. 6.
Figure 6:
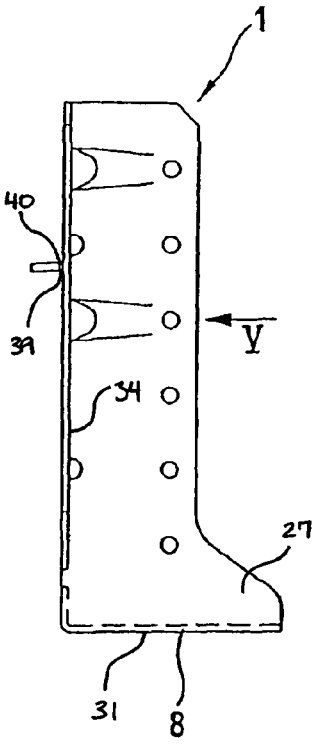
FIG. 6 shows a side view of the beam shoe according to FIG. 5, viewed in the direction of arrow VI in FIG. 5.
Figure 7:
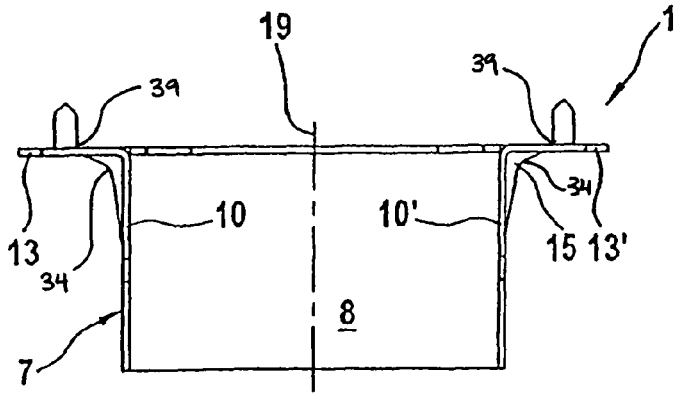
FIG. 7 shows a top view of the beam shoe according to FIGS. 5 and 6, viewed in the direction of arrow VII in FIG. 5.
Figure 8:
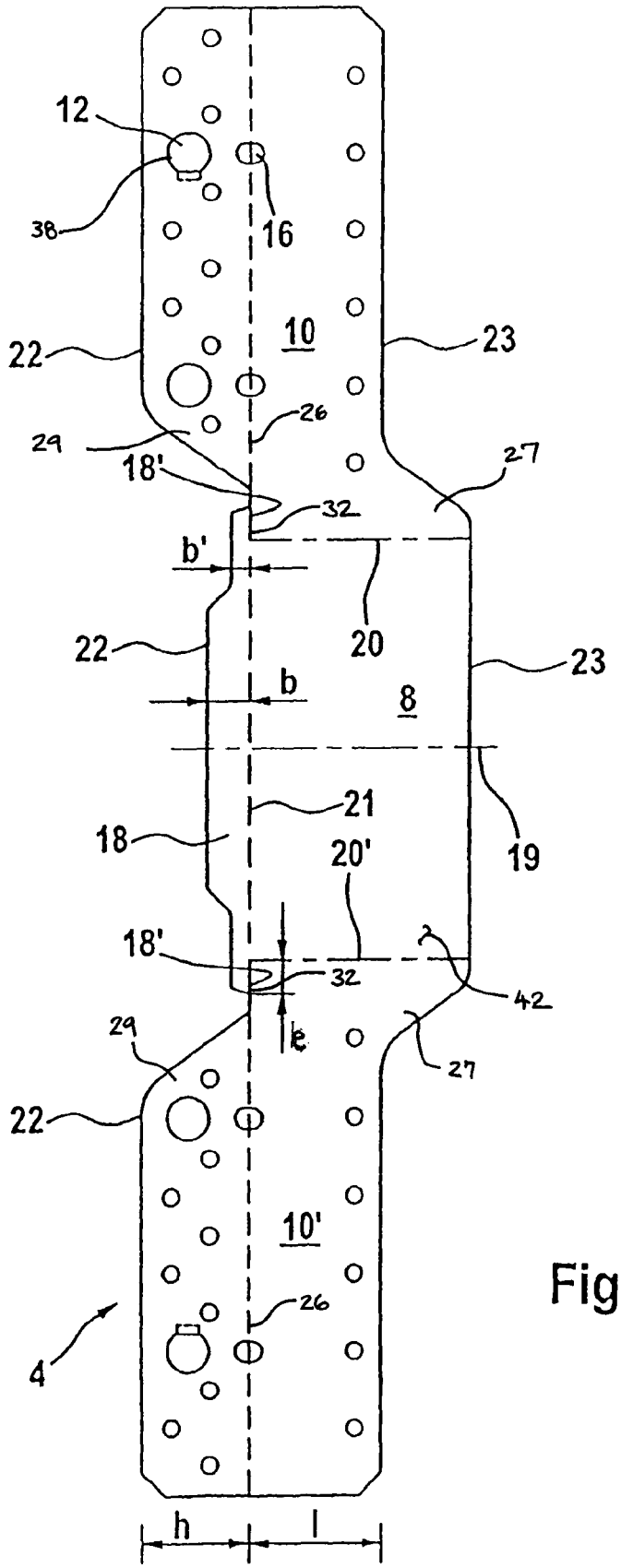
FIG. 8 shows a blank for the beam shoe according to FIGS. 5 to 7, in top view.

FIGS. 5 to 7 show another configuration of the inventive beam shoe, and FIG. 8 shows a sheet-metal blank for the beam shoe according to FIGS. 5 to 7, wherein like or corresponding details are denoted by the same reference numerals as used in the practical example according to FIGS. 1 to 4.

This beam shoe differs from the beam shoe according to FIGS. 1 to 4 by the fact that reinforcing flange 18 extends from bottom 8 not downwardly or outwardly but instead upwardly or inwardly and, in fact, also in the plane of fastening flanges 13, 13'. Therein end faces 18' of reinforcing flange 18 bear against the lower end portions of the two retaining legs 10, 10' under (compressive) stress, so that, in the assembled condition, a high section modulus is again reached in the bottom region.

This is made possible on the one hand by the fact that reinforcing flange 18 is provided adjacent its end faces 18' with a recess 25 open toward its upper border. The purpose of the recess will be explained with reference to the blank illustrated in FIG. 8.

As can be seen from FIG. 8, second bending line here also runs from longitudinal middle axis 19 beyond the first two bending lines 20, 20' with a spacing relative to rear edge 22 of middle (bottom) portion 8 located between the two first bending lines 20, 20', wherein the spacing "b" between second bending line 21 and rear edge 22 of middle portion 8 located between the two first bending lines 20, 20' is in each case reduced to a smaller size "b'" adjacent the adjacent first bending line 20 and 20' respectively. This narrower portion with reduced width "b'" is continued beyond the respective adjacent first bending line 20 and 20' for a length "b," which is equal to the height of reinforcing flange 18 in the middle portion. Therein the portion of reduced width "b" protruding beyond first bending line 20 and 20' is cut along second bending line 21 during stamping of blank 4.

If, during shaping of blank 4, the portion forming reinforcing flange 18 is bent up at right angles to bottom portion 8, its outer end portions therefore protrude beyond first bending lines 20, 20' and are located beyond the portions that in the finished condition form retaining legs 10, 10'. If these are then bent over upwardly around first bending lines 20, 20', they then form the outer end portions of the (smaller) width "b'" as is illustrated in FIG. 5: they are forced up in the plane of reinforcing flange 18 and thus form the mentioned recesses 25 along the upper border portion of reinforcing flange 18, which, by virtue of this feature, bears with its two end faces 18, 18' intimately against retaining legs 10, 10'.

In this configuration also, considerable bottom reinforcement is therefore achieved by reinforcing flange 18, although the blank is not practically loss-free as is the case for the configuration according to FIGS. 1 to 4. Instead, blank 4 would have to be cut out along its front edge in the middle region according to the contour of rear edge 22.

We claim:

1. A connection including a beam shoe (1) for attaching a first beam (2) end-on to a load-bearing construction (3), a first beam (2) and a load-bearing construction (3), said beam shoe (1) comprising:

a. a channel-shaped retaining member (7) formed from a substantially strip-like sheet metal blank (4), said retaining member (7) having a rectangular web-like bottom (8), said bottom (8) having a width (a) and two retaining flanges (10, 10'), each having a longitudinal border (26) and a lower end portion (27), bent over from said bottom (8) at right angles thereto, said bottom (8) joining said retaining flanges (10, 10') at first bending lines (20, 20'), wherein:

i. a pair of substantially planar fastening flanges (13, 13') is provided with through holes (12, 12') for rod-like fasteners (17), said fastening flanges (13, 13') being bent over at right angles along said longitudinal border (26) of each retaining flange (10, 10') and which faces said load-bearing construction (3), said fastening flanges (13, 13') each having a contact face (14, 14'), said contact faces (14, 14') facing away from said retaining member (7) and being placed on said load-bearing construction (3) and fastened thereto with said rod-like fasteners (17);

ii. said web-like bottom (8) and said lower end portions (27) of said retaining flanges (10, 10') are reinforced by a reinforcing flange (18), said reinforcing flange (18) being formed as a strip-like, continuous channel-shaped sheet-metal portion (18) running in the plane of said two fastening flanges (13, 13') and extending over said width (a) of said bottom (8) between said lower end portions (27) of said two retaining flanges (10, 10') adjacent said bottom (8), said reinforcing flange (18) being integrally connected to said bottom (8) and said lower end portions (27) of said retaining flanges (10, 10') such that said reinforcing flange extends above said bottom (8); and iii. said reinforcing flange (18) joins said web-like bottom (8) at a second bending line (21), and said second bending line (21) interconnects said longitudinal borders (26), said second bending line (21) connecting to each longitudinal border (26) directly, without intervening structures, so that said second bending line (21) and said longitudinal borders (26) are continuous and form a continuous bend in a single plane where said longitudinal borders (26) connect to said second bending line (21).

2. The connection of claim 1, wherein:

a. said fastening flanges (13, 13') are bent over outwardly from said retaining flanges (10, 10');

b. each of said fastening flanges (13, 13") has a lower end (29);

c. said bottom (8) has an underside (31); and d. said reinforcing flange (18) extends integrally downward from said lower end (29) of one fastening flange (13) to said underside (31) of said bottom (8), extends downwardly from said bottom (8) below said underside (31), and extends to said lower end (29) of the other fastening flange (13') and merges integrally into said other fastening flange (13').

3. The connection of claim 2, wherein:

a. said reinforcing flange (18) has a height (b);

b. said fastening flanges (13, 13') each have a width (h); and c. said height (b) of said reinforcing flange (18) is much smaller than said width (h) of said fastening flanges (13, 13').

4. The connection of claim 3, wherein:

a. said height (b) of said reinforcing flange (18) is approximately ¼ to ⅙ of said width (h) of said fastening flanges (13 and 13').

5. The connection of claim 1, wherein:

a. said reinforcing flange (18) has two end faces (18');

b. said lower end portions (27) of said retaining flanges (10, 10') having inner sides (32) and c. said reinforcing flange (18) is bent over inwardly between said retaining flanges (10, 10') at right angles thereto, and bears firmly with said two end faces (18') against the inner sides (32) of said lower end portions (27) of said retaining flanges (10 or 10').

6. The connection of claim 5, wherein:

a. said end faces (18') of said reinforcing flange (18) bear against both of said retaining flanges (10, 10') under compressive stress.

7. The connection of claim 5, wherein:

a. said reinforcing flange (18) has an edge (22); and b. said reinforcing flange (18) has a recess (25) adjacent each of its two end faces (18') and said recess (25) is open toward said edge (22).

8. The connection of claim 6, wherein:

a. said reinforcing flange (18) has an edge (22); and b. said reinforcing flange (18) has a notched recess (25) adjacent each of its two end faces (18') and said notched recess (25) is open toward said upper edge (22).

9. The connection of claim 4, wherein:

a. said beam shoe (1) has an angular juncture (34) between each retaining flange (10, 10') and the adjoining fastening flange (13, 13'); and b. in said angular juncture (34) between each retaining flange (10, 10') and said adjoining fastening flange (13, 13'), there is at least one outwardly directed, bead-like convex structure (15).

10. The connection of claim 7, wherein:

a. said beam shoe (1) has an angular juncture (34) between each retaining flange (10, 10') and the adjoining fastening flange (13, 13'); and b. in said angular juncture (34) between each retaining flange (10, 10') and said adjoining fastening flange (13, 13'), there is at least one outwardly directed, bead-like convex structure (15).

11. The connection of claim 9, wherein:

a. there is at least one through hole (16) for rod-like fasteners (17) in said angular juncture (34) between each retaining flange (10, 10') and the adjoining fastening flange (13, 13'), and said through hole (16) extends into both said retaining flange (10 or 10') and said fastening flange (13, 13').

12. The connection of claim 10, wherein:

a. there is at least one through hole (16) for rod-like fasteners (17) in said angular juncture (34) between each retaining flange (10, 10') and the adjoining fastening flange (13, 13'), and said through hole (16) extends into both said retaining flange (10 or 10') and said fastening flange (13, 13').

13. The connection of claim 11, wherein:

a. said first beam (2) has two side faces (36) and said load-bearing construction (3) has an attachment face (37); and b. said through holes (16) in said angular junctures (35) are formed such that the respective rod-like fastener (17) can be driven in obliquely relative to the side faces (36) of said first beam (2) and the attachment face (37) of said load-bearing construction.

14. The connection of claim 12, wherein:

a. said first beam (2) has two side faces (36) and said load-bearing construction (3) has an attachment face (37); and b. said through holes (16) in said angular junctures (35) are formed such that the respective rod-like fastener (17) can be driven in obliquely relative to the side faces (36) of said first beam (2) and the attachment face (37) of said load-bearing construction (3).

15. The connection of claim 13, wherein:

a. each of said fastening flanges (13, 13') has a contact side (14, 14') that contacts said load-bearing construction (3); and b. said fastening flanges (13, 13') collectively have at least two spike-shaped fixing projections (24) for fixing said beam shoe (1) to said load-bearing construction (3), and said projections protrude at right angles to said fastening flanges (13, 13') from said contact sides (14, 14').

16. The connection of claim 14, wherein:

a. each of said fastening flanges (13, 13') has a contact side (14, 14') that contacts said load-bearing construction (3); and b. said fastening flanges (13, 13') collectively have at least two spike-shaped fixing projections (24) for fixing to said load-bearing construction (3), and said projections protrude at right angles to said fastening flanges (13, 13') from said contact sides (14, 14').

17. The connection of to claim 15, wherein:

a. said though holes (12') have borders (38); and b. said fixing projections (24) are formed at the border (38) of a through hole (12').

18. The connection of to claim 17, wherein:

a. said fixing projections (24) have inside ends (39); and b. said fixing projections (24) each have a predetermined breaking point in the form of a notch (40) at said inside ends (39).

* * * * *